US010319323B2

(12) United States Patent
Liu

(10) Patent No.: US 10,319,323 B2
(45) Date of Patent: Jun. 11, 2019

(54) GOA DRIVING PANEL

(71) Applicant: Wuhan China Star Optoelectronics Technology Co., Ltd., Wuhan, Hubei (CN)

(72) Inventor: Yuanfu Liu, Shenzhen (CN)

(73) Assignee: WUHAN CHINA STAR OPTOELECTRONICS TECHNOLOGY CO., LTD., Wuhan (CN)

( * ) Notice: Subject to any disclaimer, the term of this patent is extended or adjusted under 35 U.S.C. 154(b) by 155 days.

(21) Appl. No.: 15/520,012

(22) PCT Filed: Mar. 14, 2017

(86) PCT No.: PCT/CN2017/076601
§ 371 (c)(1),
(2) Date: Apr. 18, 2017

(87) PCT Pub. No.: WO2018/152890
PCT Pub. Date: Aug. 30, 2018

(65) Prior Publication Data

US 2019/0035347 A1 Jan. 31, 2019

(30) Foreign Application Priority Data

Feb. 27, 2017 (CN) ..... 2017 1 0107007

(51) Int. Cl.
*G09G 3/36* (2006.01)
*G09G 3/20* (2006.01)

(52) U.S. Cl.
CPC ..... *G09G 3/3677* (2013.01); *G09G 3/20* (2013.01); *G09G 2300/0408* (2013.01);
(Continued)

(58) Field of Classification Search
CPC ..... G09G 2300/0408; G09G 3/3677; G09G 2310/0286; G09G 3/3648;
(Continued)

(56) References Cited

U.S. PATENT DOCUMENTS 9,123,310 B2 * 9/2015 Choi ..... G09G 3/3696
2003/0227431 A1 12/2003 Chung et al.
(Continued)

FOREIGN PATENT DOCUMENTS

CN 101661173 A 3/2010
CN 102053434 A 5/2011
(Continued)

OTHER PUBLICATIONS

Chinese Office Action for related Chinese Application No. 201710107007.7; action dated Sep. 18, 2018; (4 pages).
(Continued)

*Primary Examiner* — Koosha Sharifi-Tafreshi

(57) ABSTRACT

A GOA driving panel is disclosed. The GOA driving panel includes a plurality of GOA driving units and a plurality of output capacitors. Each output capacitor is arranged between a GOA driving unit and a corresponding scanning line so that an output waveform of a row scanning signal output by the GOA driving unit is a delay waveform. In the GOA driving unit, a difference among feedback voltages of pixel units in different active areas of the panel can be effectively reduced, whereby image flicker of the panel can be alleviated, and display quality thereof can be improved.

4 Claims, 3 Drawing Sheets

(52) U.S. Cl.
CPC ..... *G09G 2310/0267* (2013.01); *G09G 2310/0286* (2013.01); *G09G 2310/06* (2013.01); *G09G 2320/0233* (2013.01); *G09G 2320/0247* (2013.01)

(58) Field of Classification Search
CPC ..... G09G 2310/0267; G09G 3/3674; G09G 3/3266; G09G 2320/0247; G09G 2320/023
See application file for complete search history.

(56) References Cited

U.S. PATENT DOCUMENTS

| | | | | |
|---|---|---|---|---|
| 2007/0164954 | A1* | 7/2007 | Yang | G09G 3/3677 345/88 |
| 2008/0224961 | A1* | 9/2008 | Shin | H01L 27/1214 345/76 |

FOREIGN PATENT DOCUMENTS

| | | | |
|---|---|---|---|
| CN | 103258496 | A | 8/2013 |
| CN | 103730093 | A | 4/2014 |
| CN | 106297707 | A | 1/2017 |
| TW | 200504412 | | 6/2004 |

OTHER PUBLICATIONS

International Search Report and Written Opinion for related International Application No. PCT/CN2017/076601; report dated Oct. 23, 2017; (12 pages).

* cited by examiner

GOA DRIVING PANEL

CROSS REFERENCE TO RELATED APPLICATION

The present application claims priority of Chinese patent application CN201710107007.7, entitled "GOA Driving Panel" and filed on Feb. 27, 2017, the entirety of which is incorporated herein by reference.

FIELD OF THE INVENTION

The present disclosure relates to the technical field of display, and particularly to a Gate Driver On Array (GOA) driving panel.

BACKGROUND OF THE INVENTION

A driving circuit of a traditional Liquid Crystal Display (LCD) is generally an external integrated circuit module, and the LCD is packaged through a Tape Automated Bonding (TAB) structure. With the development of Thin Film Transistor (TFT) semiconductor technology, the popularity of narrow frame technology, and under the requirement of cost reduction, an integrated circuit arranged on a peripheral region of an LCD television panel is gradually becoming a research focus, in which a Gate Driver On Array (GOA) technology is a typical example.

In a GOA driving panel, a row scanning driving signal circuit is manufactured on an array substrate during a manufacturing procedure of the array substrate of the LCD, so that row-by-row driving scanning of pixel units can be realized. With respect to the GOA driving panel, not only a welding procedure of an external integrated circuit can be reduced and an integration level thereof can be improved, but also a production capacity thereof can be improved and a production cost thereof can be reduced. Therefore, the GOA driving panel has become a development trend in recent years.

With the popularity of narrow frame technology, large-sized LCD also needs corresponding technological support. However, when the GOA driving panel is used in the large-sized LCD, there is a delay between a gate driving signal at an input end of a gate signal transmission line (i.e., a scanning line) and the gate driving signal at a terminal of the same gate signal transmission line (i.e., the scanning line) due to the influences of resistors and capacitors in the display panel. As a result, non-uniform display and image flicker will be generated.

SUMMARY OF THE INVENTION

The present disclosure aims to reduce non-uniform display and image flicker of a GOA driving panel.

In order to solve the aforesaid technical problem, the present disclosure provides a GOA driving panel, which comprises an active area and a non-active area arranged at two opposite sides of the active area. The non-active area is provided with a plurality of GOA driving units, and each GOA driving unit is connected with one corresponding scanning line in the active area for outputting a scanning signal to the scanning line. The non-active area is further provided with a plurality of output capacitors, and each output capacitor is arranged between a GOA driving unit and a corresponding scanning line so that an output waveform of a row scanning signal output by the GOA driving unit is a delay waveform.

Preferably, the active area is provided with a switching element, a first plate of the output capacitor is arranged in a same layer as a gate of the switching element, and a second plate thereof is arranged in a same layer as a polysilicon layer of the switching element.

Preferably, the active area is provided with a switching element, a first plate of the output capacitor is arranged in a same layer as a gate of the switching element, and a second plate thereof is arranged in a same layer as a source and a drain of the switching element.

Preferably, the active area is provided with a switching element, a first plate of the output capacitor is arranged in a same layer as a source and a drain of the switching element, and a second plate thereof is arranged in a same layer as a pixel electrode.

Preferably, the active area is provided with a switching element, a first plate of the output capacitor is arranged in a same layer as a gate of the switching element, and a second plate thereof is arranged in a same layer as a pixel electrode.

Preferably, the active area is provided with pixel units arranged in an array. A pixel unit corresponding to an input end of the scanning line connected with the GOA driving unit serves as a first pixel unit, and a pixel unit corresponding to a terminal of the scanning line connected with the GOA driving unit serves as a second pixel unit. A capacitance of the output capacitor corresponding to the GOA driving unit is configured in such a way that the first pixel unit and the second pixel unit have an equal feedback voltage.

Preferably, the active area is provided with pixel units arranged in an array. A pixel unit corresponding to an input end of the scanning line connected with the GOA driving unit serves as a first pixel unit, a pixel unit corresponding to a terminal of the scanning line connected with the GOA driving unit serves as a second pixel unit, and a pixel unit corresponding to a midpoint of the scanning line connected with the GOA driving unit serves as a third pixel unit. A capacitance of the output capacitor corresponding to the GOA driving unit is configured in such a way that the first pixel unit, the second pixel unit, and the third pixel unit have an equal feedback voltage.

Preferably, the capacitance of the output capacitor is in a range from 10 fF to 1000 pF.

Preferably, the output capacitors corresponding to different stages of GOA driving units have a same capacitance.

Compared with the prior art, one embodiment or a plurality of embodiments according to the present disclosure can have the following advantages or beneficial effects.

According to the present disclosure, an output capacitor is arranged at an output end of a row scanning signal of a GOA driving unit, and a capacitance of the output capacitor is regulated according to a feedback voltage, whereby a difference among feedback voltages of pixel units in different active areas of the GOA driving panel can be effectively reduced. In this manner, non-uniform display and image flicker of the panel can be alleviated, and display quality thereof can be improved.

Other advantages, objectives, and features of the present disclosure will be further explained in the following description, and partially become self-evident therefrom, or be understood through the embodiments of the present disclosure. The objectives and advantages of the present disclosure will be achieved through the structure specifically pointed out in the description, claims, and the accompanying drawings.

BRIEF DESCRIPTION OF THE DRAWINGS

The accompanying drawings provide further understandings of the present disclosure or the prior art, and constitute one part of the description. The drawings are used for interpreting the present disclosure together with the embodiments, not for limiting the present disclosure. In the drawings.

DETAILED DESCRIPTION OF THE EMBODIMENTS

The present disclosure will be explained in details with reference to the embodiments and the accompanying drawings, whereby it can be fully understood how to solve the technical problem by the technical means according to the present disclosure and achieve the technical effects thereof, and thus the technical solution according to the present disclosure can be implemented. It should be noted that, as long as there is no structural conflict, all the technical features mentioned in all the embodiments may be combined together in any manner, and the technical solutions obtained in this manner all fall within the scope of the present disclosure.

Figure 1:
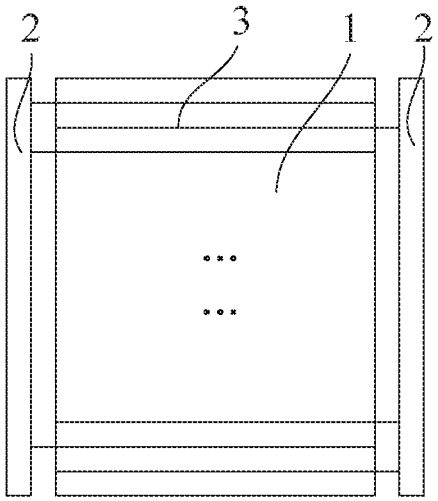
Fig. 1 Prior Art
FIG. 1 schematically shows a GOA driving circuit of a GOA driving panel in the prior art.

FIG. 1 schematically shows a GOA driving circuit of a GOA driving panel in the prior art. As shown in FIG. 1, the panel has a double-side driving structure. That is, a GOA driving circuit 2 is arranged at two sides of an active area 1 respectively. The GOA driving circuit 2 is constituted by multiple stages of GOA driving units in a cascade manner, and each stage of GOA driving unit is used for driving pixel units in different rows.

For example, the GOA driving circuit 2 arranged at a left side of the active area 1 drives pixel units in odd-numbered rows, while the GOA driving circuit 2 arranged at a right side of the active area 1 drives pixel units in even-numbered rows. As shown in FIG. 1, a scanning line is represented by 3. In the display panel, each pixel unit is provided with a switching element, and gates of switching elements in all pixel units of one pixel row are connected with a same scanning line 3. A connection between a switching element and a scanning line 3 is not shown in FIG. 1, and reference can be made to related content in the prior art.

Figure 2:
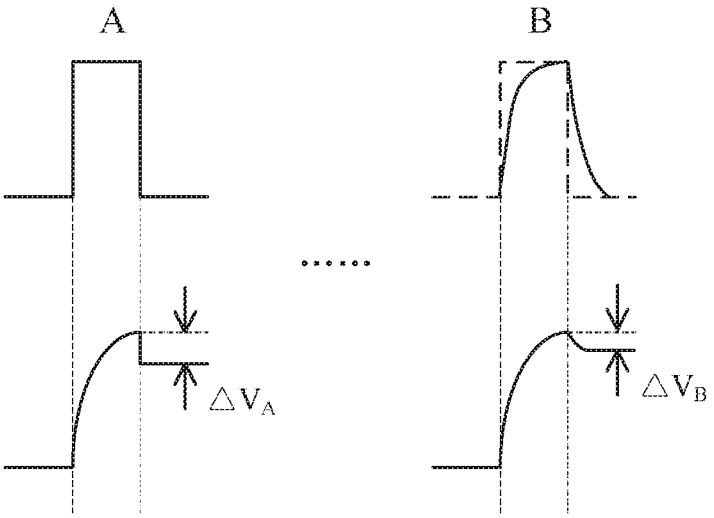
Fig. 2 Prior Art
FIG. 2 schematically shows waveforms of a row scanning signal at different positions of a same scanning line of a GOA driving panel in the prior art.

During practical driving procedure, a GOA driving unit outputs a perfect square wave at a row scanning signal output end thereof, as shown by waveform A in FIG. 2. The row scanning signal is used for turning on switching elements that are connected with a scanning line corresponding to this stage of GOA driving unit. When a gate voltage of a switching element increases or decreases suddenly, a feedback voltage can be generated on a pixel electrode due to influences of a parasite capacitor between a gate and a drain of the switching element and storage capacitors in the display panel. The feedback voltage is superposed on a voltage of the pixel electrode, and consequently, the actual voltage of the pixel electrode will deviate from its preset value.

As shown in FIG. 2, there is a feedback voltage $\Delta V_A$ at a declining side of the waveform A. The feedback voltage enables the voltage of the pixel electrode to have a decreasing trend. The feedback voltage is superposed on the voltage of the pixel electrode, and thus the actual voltage of the pixel electrode is less than its preset value. Under this circumstances, if no measure is taken to maintain the voltage on the pixel electrode, a voltage difference between the pixel electrode and a common electrode would change. As a result, a gray-scale value of an image displayed therein will be incorrect, and non-uniform display will be generated. In the prior art, the voltage difference between the pixel electrode and the common electrode is generally maintained at the preset value through reducing a voltage on the common electrode. That is, the voltage on the common electrode is reduced by a value of the feedback voltage.

In a large-sized liquid crystal display device, since an active area thereof is large, influences of resistors and capacitors in the display device on the row scanning signal would become more apparent, and the non-uniform display problem would become more complicated.

As shown in FIG. 2, waveform B is another waveform of a row scanning signal at a different position of a scanning line from a position of waveform A. The waveform A is at a signal input end of the scanning line, while the waveform B is at a terminal of the scanning line. At a moment when the switching element is turned off, a voltage of waveform A jumps from a turn-on voltage to a turn-off voltage rapidly. At this time, the voltage difference on the gate of the switching element is a largest one, and the corresponding feedback voltage $\Delta V_A$ is also a largest one. At a moment when the switching element is turned off, a voltage of waveform B gradually changes into the turn-off voltage from the turn-on voltage, rather than jumps from the turn-on voltage to the turn-off voltage rapidly. At this time, the voltage difference on the gate of the switching element is a smallest one, and a corresponding feedback voltage $\Delta V_B$ is also a smallest one. Waveforms of the signal at other positions of the scanning line gradually change from waveform A to waveform B. That is, during actual operational procedure, the feedback voltages of each pixel unit connected with the same scanning line are different from one another, and the feedback voltage decreases gradually from the signal input end of the scanning line to the terminal thereof.

When the feedback voltages at different positions of the scanning line are unequal to one another, the image flicker will be generated if the voltage difference between the pixel electrode and the common electrode is still maintained at the preset value through reducing the voltage on the common electrode since the common electrode in a liquid crystal display device is a whole electrode.

Figure 3:
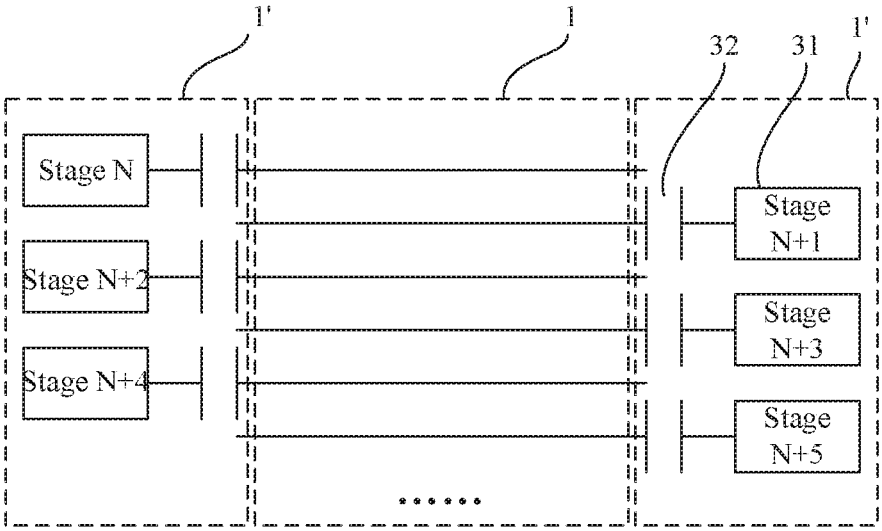
FIG. 3 schematically shows a structure of a GOA driving panel according to one embodiment of the present disclosure.

In order to solve the aforesaid technical problem, the present disclosure provides a GOA driving panel, as shown in FIG. 3.

As shown in FIG. 3, 1 represents an active area, and 1' represents a non-active area arranged at two opposite sides of the active area 1. The non-active area 1' is provided with a plurality of GOA driving units 31, and each GOA driving unit 31 is connected with one scanning line in the active area 1 for outputting a scanning signal to a corresponding scanning line. The non-active area 1' is further provided with a plurality of output capacitors 32, and each output capacitor 32 is arranged between a GOA driving unit 31 and a corresponding scanning line so that an output waveform of a row scanning signal output by the GOA driving unit 31 is a delay waveform.

As shown in FIG. 3, each stage of GOA driving unit 31 is provided with an output capacitor 32. A first plate of the output capacitor 32 is connected with a row scanning signal output end of the GOA driving unit 31, and a second plate of the output capacitor 32 is connected with a scanning line corresponding to the GOA driving unit 31.

According to one embodiment of the present disclosure, the first plate of the output capacitor 32 is arranged in a same layer as a gate of the switching element, and the second plate thereof is arranged in a same layer as a polysilicon layer of the switching element.

Specifically, during a procedure when the gate of the switching element is manufactured, the first plate of the output capacitor 32 is formed at the same time. During a procedure when the polysilicon layer of the switching element is manufactured, the polysilicon layer near to the first plate of the output capacitor 32 is light doped so as to form a medium layer of the output capacitor 32, and other part of the polysilicon layer is heavy doped so as to form the second plate of the output capacitor 32.

According to one embodiment of the present disclosure, the first plate of the output capacitor 32 is arranged in a same layer as a source and a drain of the switching element, and the second plate thereof is arranged in a same layer as the polysilicon layer of the switching element.

Specifically, during a procedure when the source and the drain of the switching element are manufactured, the first plate of the output capacitor 32 is formed at the same time. During a procedure when the polysilicon layer of the switching element is manufactured, the polysilicon layer near to the first plate of the output capacitor 32 is light doped so as to form a medium layer of the output capacitor 32, and other part of the polysilicon layer is heavy doped so as to form the second plate of the output capacitor 32.

According to one embodiment of the present disclosure, the first plate of the output capacitor 32 is arranged in a same layer as the gate of the switching element, and the second plate thereof is arranged in a same layer as the source and the drain of the switching element.

Specifically, during a procedure when the gate of the switching element is manufactured, the first plate of the output capacitor 32 is formed at the same time. During a procedure when the source and the drain of the switching element are manufactured, the second plate of the output capacitor 32 is formed at the same time. One insulation layer or a plurality of insulation layers between a layer on which the gate of the switching element is arranged and a layer on which the source and the drain of the switching element are arranged can serve as a medium layer of the output capacitor 32.

According to one embodiment of the present disclosure, the first plate of the output capacitor 32 is arranged in a same layer as the source and the drain of the switching element, and the second plate thereof is arranged in a same layer as the pixel electrode.

Specifically, during a procedure when the source and the drain of the switching element are manufactured, the first plate of the output capacitor 32 is formed at the same time. During a procedure when the pixel electrode is manufactured, the second plate of the output capacitor 32 is formed at the same time. One insulation layer or a plurality of insulation layers between a layer on which the source and the drain of the switching element are arranged and the pixel electrode can serve as the medium layer of the output capacitor 32.

According to one embodiment of the present disclosure, the first plate of the output capacitor 32 is arranged in a same layer as the gate of the switching element, and the second plate thereof is arranged in a same layer as the pixel electrode.

Specifically, during a procedure when the gate of the switching element is manufactured, the first plate of the output capacitor 32 is formed at the same time. During a procedure when the pixel electrode is manufactured, the second plate of the output capacitor 32 is formed at the same time. One insulation layer or a plurality of insulation layers between a layer on which the gate of the switching element is arranged and the pixel electrode can serve as the medium layer of the output capacitor 32.

It should be noted that, according to the aforesaid embodiments, the first plate and the second plate of the output capacitor 32 can be exchanged with each other, and the polarity of the first plate or the second plate is not defined.

In the GOA driving panel according to the present embodiment, a difference among feedback voltages of different pixel units can be reduced, which will be illustrated hereinafter with reference to FIG. 4.

Figure 4:
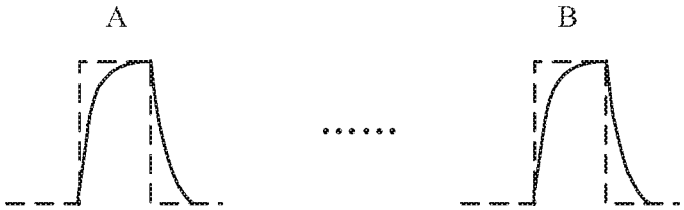
FIG. 4 schematically shows waveform changing of a row scanning signal at different positions of a same scanning line of a GOA driving panel according to one embodiment of the present disclosure.

As shown in FIG. 4, since each stage of GOA driving unit is provided with the output capacitor at the row scanning signal output end thereof, a perfect square wave output by the GOA driving unit can be changed into a delay waveform due to a delay effect of the output capacitor on the signal. As shown in FIG. 4, a dotted line represents a perfect square wave, and a waveform with irregular rising curve and declining curve is the delay waveform.

During transmission procedure through a scanning line, the delay waveform will change continuously due to the delay effect of resistors and capacitors in the display panel. However, the change occurring to the delay waveform is far less than the change occurring to the perfect square waveform, and thus the difference among feedback voltages at different positions of the same scanning line can be reduced. As shown in FIG. 4, waveform A is a waveform of a row scanning signal corresponding to a pixel unit at a signal input end of a scanning line, and waveform B is another waveform of the row scanning signal corresponding to a pixel unit at a terminal of the same scanning line. It can be seen that, the difference between waveform A and waveform B is not apparent any more.

Further, the capacitance of the output capacitor can be regulated so that the feedback voltages at different positions of the same scanning line can have an almost equal value.

Figure 5:
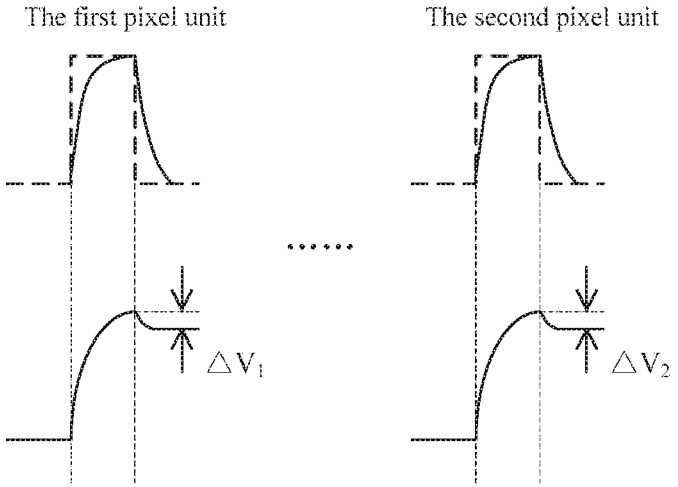
FIG. 5 and FIG. 6 schematically show waveforms of a row scanning signal at different positions of a same scanning line of a GOA driving panel according to one embodiment of the present disclosure.

According to one embodiment of the present disclosure, one pixel unit is selected at the input end of the scanning line and the terminal thereof respectively, as shown in FIG. 5. A pixel unit corresponding to the input end of the scanning line serves as a first pixel unit, and a pixel unit corresponding to the terminal of the scanning line serves as a second pixel unit. The capacitance of the output capacitor corresponding to the pixel unit row (i.e., corresponding to the GOA driving unit of the pixel unit row) is configured in such a way that the first pixel unit and the second pixel unit have an equal feedback voltage.

Specifically, as shown in FIG. 5, the feedback voltage corresponding to the first pixel unit is $\Delta V_1$, and the feedback voltage corresponding to the second pixel unit is $\Delta V_2$. The capacitance of the output capacitor can be regulated so that $\Delta V_1$ is equal to $\Delta V_2$. At this time, it is considered that the feedback voltages of each pixel unit of the same scanning line are all equal to one another.

Figure 6:
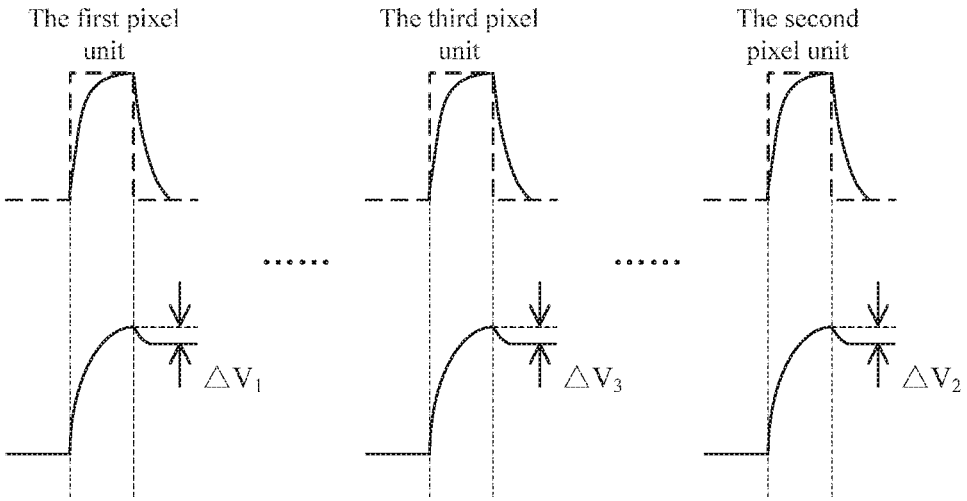

According to another embodiment of the present disclosure, one pixel unit is selected at the input end of the scanning line, a midpoint thereof, and the terminal thereof respectively, as shown in FIG. 6. A pixel unit corresponding to the input end of the scanning line serves as a first pixel unit; a pixel unit corresponding to the terminal of the scanning line serves as a second pixel unit; and a pixel unit corresponding to the midpoint of the scanning line serves as a third pixel unit. The capacitance of the output capacitor corresponding to the pixel unit row (i.e., corresponding to the GOA driving unit of the pixel unit row) is configured in such a way that the first pixel unit, the second pixel unit, and the third pixel unit have an equal feedback voltage.

Specifically, as shown in FIG. 6, the feedback voltage corresponding to the first pixel unit is $\Delta V_1$; the feedback voltage corresponding to the second pixel unit is $\Delta V_2$; and the feedback voltage corresponding to the third pixel unit is $\Delta V_3$. The capacitance of the output capacitor can be regulated so that $\Delta V_1$ is equal to $\Delta V_2$ and $\Delta V_3$. At this time, it is considered that the feedback voltages of each pixel unit of the same scanning line are all equal to one another.

It can be seen that, based on ideal design of the GOA driving panel, i.e., the wave output by each stage of GOA driving unit is a perfect square wave, the resistors and capacitors in the display panel have an equal influence on the pixel units in each row, and so on, the output capacitors corresponding to different stages of GOA driving units have a same capacitance.

In addition, according to the embodiment of the present disclosure, the capacitance of the output capacitor can be regulated in a range from 10 fF to 1000 pF.

According to the present embodiment, the output capacitor is arranged at the output end of the row scanning signal of each stage of GOA driving unit, and the capacitance of the output capacitor can be regulated so that the feedback voltages of each pixel unit of the same scanning line are almost equal to one another. In this manner, the non-uniform display of the GOA driving panel can be alleviated. Based on the capacitance of each output capacitor after regulation, a unified deviation value of the voltage on the common electrode can be obtained. The voltage on the common electrode can be compensated based on the unified deviation value thereof, whereby image flicker of the display panel can be significantly reduced, and a display quality can be improved.

The above embodiments are described only for better understanding, rather than restricting, the present disclosure. Any person skilled in the art can make amendments to the implementing forms or details without departing from the spirit and scope of the present disclosure. The protection scope of the present disclosure shall be determined by the scope as defined in the claims.

The invention claimed is:

1. A Gate Driver On Array (GOA) driving panel, comprising an active area and a non-active area arranged at two opposite sides of the active area, wherein the non-active area is provided with a plurality of GOA driving units, and each GOA driving unit is connected with one corresponding scanning line in the active area for outputting a scanning signal to the scanning line; and wherein the non-active area is further provided with a plurality of output capacitors, a first plate of each output capacitor is connected with a row scanning signal output end of a corresponding GOA driving unit, and a second plate of the each output capacitor is connected with a scanning line of the corresponding GOA driving unit so that an output waveform of a row scanning signal output by the GOA driving unit is a delay waveform.

2. A Gate Driver On Array (GOA) driving panel, comprising an active area and a non-active area arranged at two opposite sides of the active area, wherein the non-active area is provided with a plurality of GOA driving units, and each GOA driving unit is connected with one corresponding scanning line in the active area for outputting a scanning signal to the scanning line;

wherein the non-active area is further provided with a plurality of output capacitors, and each output capacitor is arranged between a GOA driving unit and a corresponding scanning line so that an output waveform of a row scanning signal output by the GOA driving unit is a delay waveform;

wherein the active area is provided with a switching element, a first plate of the output capacitor is arranged in a same layer as a source and a drain of the switching element, and a second plate thereof is arranged in a same layer as a pixel electrode;

wherein the active area is provided with pixel units arranged in an array;

wherein a pixel unit corresponding to an input end of the scanning line connected with the GOA driving unit serves as a first pixel unit, a pixel unit corresponding to a terminal of the scanning line connected with the GOA driving unit serves as a second pixel unit, and a pixel unit corresponding to a midpoint of the scanning line connected with the GOA driving unit serves as a third pixel unit; and wherein a capacitance of the output capacitor corresponding to the GOA driving unit is configured in such a way that the first pixel unit, the second pixel unit, and the third pixel unit have an equal feedback voltage; and wherein the capacitance of the output is in a range from 10 fF to 1000 pF.

3. The GOA driving panel according to claim 2, wherein the output capacitors corresponding to different stages of GOA driving units have a same capacitance.

4. The GOA driving panel according to claim 1, wherein different feedback voltages corresponding to different positions of a same scanning line have an almost equal value.

* * * * *